US011324078B2

(12) United States Patent
Aybar et al.

(10) Patent No.: US 11,324,078 B2
(45) Date of Patent: May 3, 2022

(54) SYSTEM AND METHOD FOR HEATING A WINDOW

(71) Applicant: Ford Global Technologies, LLC, Dearborn, MI (US)

(72) Inventors: Yucel Aybar, Basildon (GB); Gary Clarke, Leigh on Sea (GB)

(73) Assignee: Ford Global Technologies, LLC, Dearborn, MI (US)

( * ) Notice: Subject to any disclaimer, the term of this patent is extended or adjusted under 35 U.S.C. 154(b) by 287 days.

(21) Appl. No.: 16/439,576

(22) Filed: Jun. 12, 2019

(65) Prior Publication Data

US 2019/0387584 A1 Dec. 19, 2019

(30) Foreign Application Priority Data

Jun. 13, 2018 (GB) ..... 1809693

(51) Int. Cl.
*H05B 3/84* (2006.01)

(52) U.S. Cl.
CPC ..... *H05B 3/84* (2013.01); *H05B 2203/005* (2013.01); *H05B 2203/016* (2013.01); *H05B 2203/031* (2013.01); *H05B 2214/02* (2013.01)

(58) Field of Classification Search
CPC ..... H05B 3/84; H05B 3/86; H05B 2203/005; H05B 2203/016; H05B 2203/031; H05B 2214/02; B60J 1/002; B60S 1/026
See application file for complete search history.

(56) References Cited

U.S. PATENT DOCUMENTS

| | | | | |
|---|---|---|---|---|
| 5,466,911 | A | 11/1995 | Spagnoli et al. | |
| 5,796,071 | A | 8/1998 | Morin et al. | |
| 2004/0159645 | A1 | 8/2004 | Gillner et al. | |
| 2005/0040151 | A1* | 2/2005 | Dyrdek | H05B 3/84 219/203 |
| 2005/0178756 | A1 | 8/2005 | Degand et al. | |
| 2006/0201932 | A1 | 9/2006 | Degand et al. | |
| 2008/0035629 | A1 | 2/2008 | Thiry et al. | |
| 2010/0146589 | A1* | 6/2010 | Safa | G06F 21/52 726/3 |

(Continued)

FOREIGN PATENT DOCUMENTS

| | | | |
|---|---|---|---|
| EP | 3112572 | A1 | 1/2017 |
| JP | H02-46683 | A | 2/1990 |

(Continued)

OTHER PUBLICATIONS

Search and Examination issued in United Kingdom Application No. GB1809693.3, dated Dec. 7, 2018 (7 pages).

*Primary Examiner* — Shawntina T Fuqua
(74) *Attorney, Agent, or Firm* — Frank Lollo; Eversheds Sutherland (US) LLP

(57) ABSTRACT

A system for heating a window, the system comprises: a window movably disposed within a housing, the window comprising a first window heating zone and a second window heating zone; a heating device for heating at least one of the first window heating zone and the second window heating zone; and an actuator configured to determine which of the first and second window heating zones to heat depending on at least one of: the position of the window within the housing; and the height of an eye line of a user of the system.

19 Claims, 4 Drawing Sheets

(56) References Cited

U.S. PATENT DOCUMENTS

| | | | | |
|---|---|---|---|---|
| 2010/0146859 | A1* | 6/2010 | Gipson | E05F 15/632 49/348 |
| 2011/0147153 | A1* | 6/2011 | Rutkowski | B60S 1/56 191/12.2 R |
| 2013/0186875 | A1 | 7/2013 | Lisinski et al. | |
| 2016/0198525 | A1* | 7/2016 | Dudar | H05B 1/0236 219/203 |
| 2017/0135155 | A1 | 5/2017 | Klein et al. | |

FOREIGN PATENT DOCUMENTS

| | | | |
|---|---|---|---|
| JP | 2008-056225 | A | 3/2008 |
| WO | 2016/119950 | A1 | 8/2016 |
| WO | 2017/077128 | A1 | 5/2017 |
| WO | 2017/077133 | A1 | 5/2017 |

* cited by examiner

SYSTEM AND METHOD FOR HEATING A WINDOW

CROSS-REFERENCE TO RELATED APPLICATIONS

This application claims priority to and the benefit of United Kingdom patent application No. GB 1809693.3, filed Jun. 13, 2018, which is hereby incorporated by reference herein in its entirety.

FIELD

The present invention relates to a system for heating a window, and particularly, although not exclusively, to a system for heating a window in a vehicle, for example a motor vehicle.

BACKGROUND

When a window becomes fogged or iced certain areas through the window become not visible. From time to time therefore windows need to be de-iced and/or defogged following icy, snowy or foggy weather conditions to improve visibility through the windows such that certain visibility areas through the windows can become visible again.

Some methods for heating windows so that they can become de-iced or defogged involve directing heat from a heat source toward the window, for example from a vehicle air vent. Such methods can suffer from disadvantages including that heat cannot be directed to a particular area of interest, such as one particular part on a window, for example and they can be time consuming to heat large glass areas.

Windows on vehicles, for example motor vehicles, can become fogged or iced in certain weather conditions. This can be problematic as fogged or iced windows can prevent the driver from seeing certain areas through the window. For example, a fogged or iced window can prevent the driver from seeing the area adjacent their car (via a wing mirror) or can prevent the driver from properly checking their blind spots. Exterior wing mirrors and/or blind spots may therefore be not visible in certain weather conditions, for example when a vehicle's mirrors are covered with ice, snow, or fog.

Some de-icing and de-fogging systems in, for example, motor vehicles provide heating, for example electrical heating, only to the front and rear windows, relying on warm air from inside the vehicle being directed to the side windows to de-ice and defog those windows. As such systems do not heat the side windows directly these systems may not provide efficient de-icing etc. Furthermore, relying on warm air being directed from inside the vehicle, for example from the heater vents, cannot focus heat on any specific area of the window, e.g. a blind spot. As such, these systems not only take time for the air to reach the window but they are not capable of focusing heat on any specific visibility areas. Such systems can therefore be limited to heating areas of the side windows that do not cover the driver's blind spots.

Furthermore, certain visibility areas of interest, for example, a driver's blind spots, may change depending on any of the height of the driver, the height of the seat within the vehicle, and the position of the window in the vehicle relative to the driver.

There remains therefore a need for improvements in the art concerning maintaining user visibility in certain weather conditions.

STATEMENTS OF INVENTION

According to an arrangement of the present invention there is provided a system for heating a window, the system comprising: a window movably disposed within a housing, the window comprising a first window heating zone and a second window heating zone; a heating device for heating at least one of the first window heating zone and the second window heating zone; and an actuator configured to determine which of the first and second window heating zones to heat depending on at least one of: the position of the window within the housing; and the height of an eye line of a user of the system.

Accordingly, a visibility area on a window may be determined and changed dependent on a line of sight of a user of the system. For example, when the window is being moved relative to its housing, the system may disrupt power to the heating device so that a window area the user is no longer looking through is no longer heated and may provide power to areas of the window that the user is now looking through. This has particular utility in vehicles when the window is a side vehicle window and the user (i.e. driver or passenger) raises or lowers the window. This movement will effect which part of the window the user needs to look through to check their blind spot. Accordingly, the system when employed in vehicles can defrost or de-ice the fogged parts of the vehicle's side windows that could otherwise prevent the user from checking their blind spot.

However, the system is not limited to utility in vehicles and also finds use in offices, hotels, homes etc. where parts of a moveable window may require heating.

The actuator may comprise a controller or processor configured to sense and/or determine an eye line of the user of the system and actuate the heating device to heat at least one of the first and second window heating zones based on where it is determined the user is looking.

The heating device may comprise at least one heating element, and each of the first and second window heating zones may comprise a heating element. Separate or combined heating of the first and/or second heating zones may therefore be provided by supplying power to the respective heating element of the window heating zone. The actuator may be configured to supply power, either actively or passively, to at least one of the at least one heating elements. For example, the actuator may itself be a power source or the actuator may be a component configured to selectively engage or disengage the heating element(s) from a power source.

The system may further comprise at least one electrical contact for transmitting power to the heating device, and the actuator may be configured to selectively engage or disengage the at least one contact from a power supply to selectively heat at least one of the first and second window heating zones. Alternatively, movement of the window relative to the housing may selectively engage or disengage the at least one contact from a power supply to selectively heat at least one of the first and second window heating zones. One electrical contact may be provided for each of the first and second window heating zones. Therefore, in some arrangements each window heating zone may comprise a heating element for heating that zone. A power supply may be selectively engageable to the electrical contact to selectively provide power to the heating elements to heat a respective window heating zone. The actuator may be configured to connect or disconnect the electrical contact(s) to heat the zones. For example, the actuator may comprise a controller or processor and/or a switch configured to automatically vary power supply to the or each electrical contact.

The actuator may comprise a sensor configured to sense the position of the window relative to the window housing, and the actuator may be configured to actuate the heating device to heat at least one of the first and second window heating zones based on the measurements of the sensor. The actuator may comprise a controller or processor which may comprise the sensor. In one arrangement the system is comprised in a vehicle and the actuator may be comprised in at least one component of the software of the vehicle.

The system may further comprise a conductor for supplying power to the heating device, wherein the conductor may extend between the actuator and the heating device, and wherein the actuator may be configured to manage the length of the conductor between the actuator and the heating device. This allows a continuous supply of power, e.g. electricity, to the heating device at the range of positions of the window relative to the housing. Continuous electrical connection is therefore permitted. As the actuator may manage the length of conductor, the conductor is able to 'follow' the path of the window in the sense that, if the heating device moves further away from the actuator, the actuator may let out a portion of conductor to maintain continuous electrical connection therewith. The conductor may also be kept clear of any other parts in the system, for example moving parts, that could damage the wiring or those other parts. This may also allow the conductor's length to be shortened, e.g. automatically, as necessary to avoid it becoming trapped between any moving components.

The actuator may be rotatably disposed on an actuator housing, such as a bracket or mount that is connected to the housing. Alternatively the actuator may be directly rotatably connected to the housing. The conductor may be wound around a core of the actuator and rotational movement of the actuator may vary the length of the conductor between the actuator and the heating device.

The actuator may comprise a rolling centre and a spring force or other biasing element such that the force on the conductor is dynamically controlled, preventing the length of the conductor from being too long or the conductor from being too loose. This may also ensure that the conductor is under enough tension to stay straight between the actuator and the heating device.

The actuator may be configured to actuate the heating device to heat at least one of the first and second window heating zones based on at least one of: the length of conductor between the actuator and the heating device, the angle that the conductor makes with the housing, and the rotational position of the actuator. Therefore the actuator may be a mechanical component configured to automatically actuate the heating device to heat at least one of the first and second window heating zones dependent on an inherent property of the system, e.g. conductor length or rotational position of the actuator. As such properties may be intrinsically linked with the position of the window within the housing the actuator may be configured to automatically heat at least one of the first and second window heating zones depending on the position of the window within the housing, as will be discussed below.

The system may further comprise at least one electrical contact for transmitting power to the heating device, and the actuator may be configured to selectively engage or disengage the at least one contact from a power supply to selectively heat at least one of the first and second window heating zones based on at least one of: the length of conductor between the actuator and the heating device, the angle that the conductor makes with the housing, and the rotational position of the actuator.

The system may further comprise a biasing element for maintaining the conductor at a tension above a predetermined level. This may ensure that the conductor is biased toward a preferred conductor length or tension. This, in turn, may aid in preventing damage to the conductor, e.g. from contact with other components.

The biasing element may be configured to bias the actuator into a first rotational position. Rotational movement of the actuator may vary the length of the conductor and as such the biasing element may bias the system toward a preferred conductor length or tension.

The window may be movable within a window movement range between a first window position and a second window position, relative to the housing, and the actuator may be positioned on the housing in approximately the centre of the window movement range. This allows the actuator be positioned such that a minimum length of conductor between the actuator and the heating device may be used. For example, if the actuator were disposed at one end of the window movement path then the length of conductor may be its shortest at this position, and become continually longer as the window advances on its movement path. If the actuator is at the centre of a window movement range the conductor length may be at its longest at either end of the movement range and at its shortest when the window is approximately in the middle of its movement range. However, the longest length of conductor if the actuator is positioned in the middle may be less than the longest length of conductor if the actuator were positioned at either end.

The actuator may be configured to power the heating device when the window is not moving relative to the housing, and/or to disrupt power to the heating device when the window is moving relative to the housing.

According to another arrangement of the invention there is provided a vehicle comprising the system described above, wherein the side of the vehicle comprises the housing and wherein at least one of a front side window and a back side window comprises the window.

The actuator may be configured to power the heating device to heat at least one of the first and second window heating zones based on a heating function of at least one of the front and rear windows of the vehicle being activated. For example the actuator may comprise a switch configured to actuate the system to provide power to the heating device, and may also provide power to at least one of the front and rear windows. The switch may be user-actuatable. The switch may be coupled with the front and/or rear heated window switches so that heating of the front and/or rear windows and the side windows may be accomplished at the same time.

The actuator may comprise a controller or processor configured to sense and/or determine an eye line of the user of the system and actuate the heating device to heat at least one of the first and second window heating zones based on where it is determined the user is looking. Such a component may be provided in the console of the interior of the vehicle.

The controller may be configured to actuate the heating device after a predetermined amount of time has elapsed, e.g. 1-5 minutes.

The actuator may comprise a mechanical component having configurations in which electrical power is supplied or disrupted to the heating device. Alternatively, the actuator may comprise an electrical component such as a transceiver configured to transmit a signal to actuate the heating device.

According to another arrangement of the present invention there is provided a system for heating a window, the system comprising: a window movably disposed within a housing, the window comprising a first, second and third window heating zone; a heating device for heating at least one of the first, second, and third window heating zones; and an actuator configured to determine which of the first, second, and third window heating zones to heat depending on at least one of: the position of the window within the housing; and the height of an eye line of a user of the system.

The window heating zones may be disposed horizontally or vertically with respect to one another. Accordingly a single window may be divided up into a plurality of horizontal and/or vertical heating zones.

According to an arrangement of the invention there is also provided a method of heating a window, the method comprising: determining at least one of an eye line of a user and the position of a window within a housing; and based on this determination, heating a portion of the window corresponding to an eye line of the user.

BRIEF DESCRIPTION OF DRAWINGS

For a better understanding of the present invention, and to illustrate how it may be put into effect, reference is now made, by way of example only, to the accompanying drawings in which.

DETAILED DESCRIPTION

Figure 1:
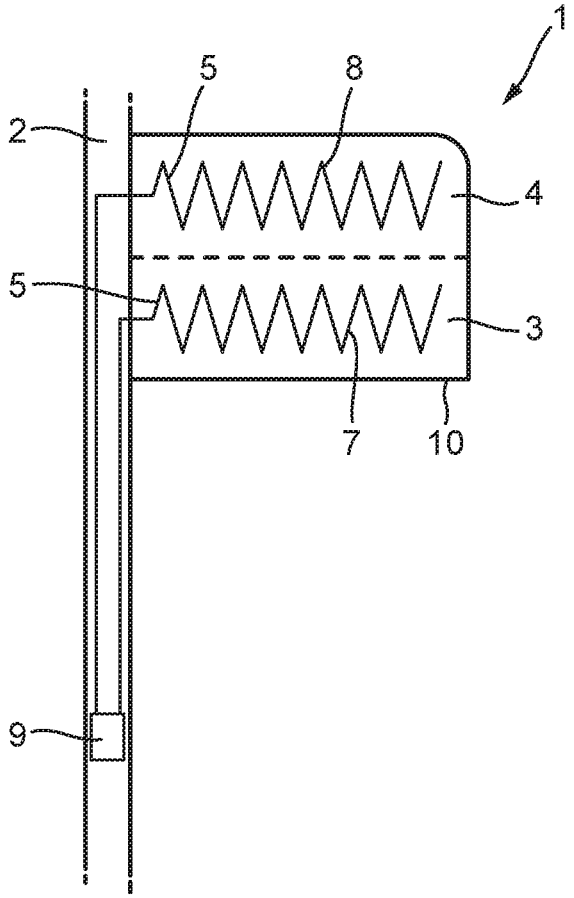
FIG. 1 is a perspective view of a system for heating a window according to an arrangement of the present invention.

FIG. 1 shows a system 1 for heating a window 10. The window 10 is movably disposed within a housing 2 and comprises a first window heating zone 3 and a second window heating zone 4. A heating device 5 is provided for heating at least one of the first and second window heating zones 3, 4. FIG. 1 shows that the heating device 5 comprises a first heating element 7 for heating the first window heating zone 3 and a second heating element 8 for heating the second window heating zone 4. An actuator 9 is provided and is configured to determine which of the first and second heating zones 3, 4, to heat depending on at least one of: the position of the window 10 within the housing 2, and the height of an eye line of a user of the system.

As shown in FIG. 1 the window 10 has been divided into two horizontal window heating zones, with each window heating zone containing a heating device or heating element. However, in other arrangements, the window may be divided up into more than two window heating zones and/or may comprise two window heating zones oriented vertically with respect to one another. An individual window heating zone may not comprise its own heating device as in some arrangements a single heating device may be configured to heat at least two window heating zones. For example, a heating device may extend across and/or through two window heating zones.

The actuator 9 may comprise a controller configured to determine at least one of the position of the window relative to the window housing and the position and eye line of the user of the system. The actuator 9 is configured to actuate the heating element 5 to heat at least one of the first and second heating zones 3, 4. For example, the actuator 9 may be configured to heat only one of the first and second heating zones 3, 4 by actuating only one of the heating elements 7, 8.

Figure 2B:
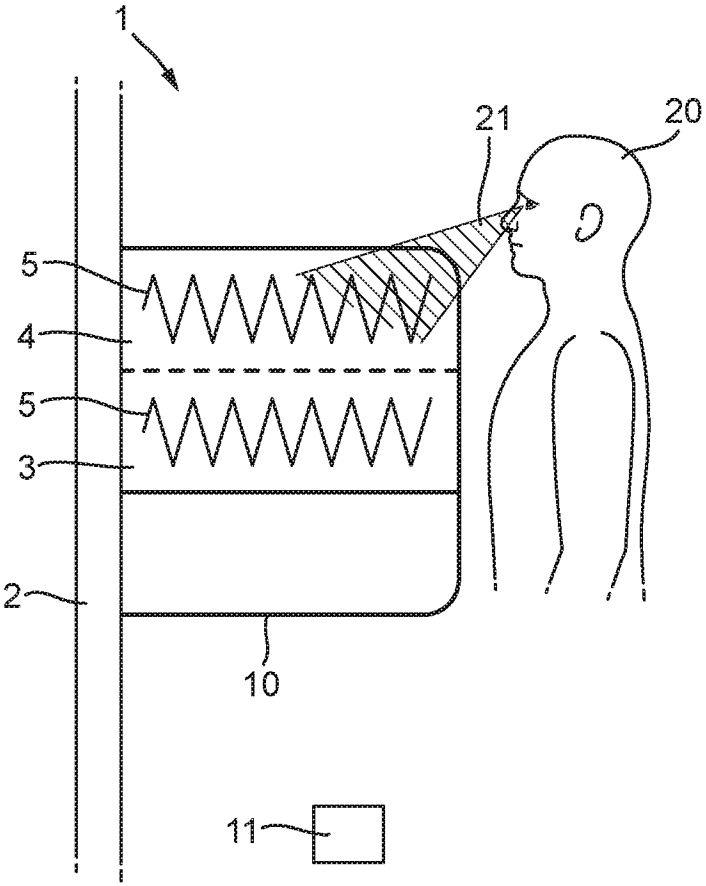
FIGS. 2A and 2B are perspective views of a system for heating a window according to an arrangement of the invention.
Figure 2A:
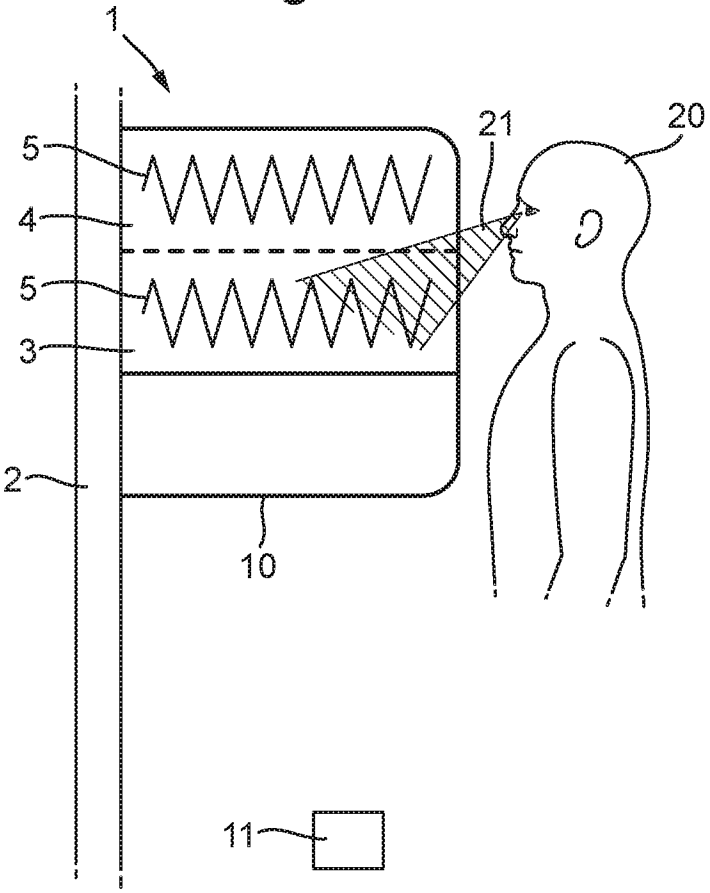

FIGS. 2A and 2B show the system 1 in a first configuration (shown in FIG. 2A) and a second configuration (shown in FIG. 2B). FIG. 2A shows the system 1 in the first configuration in which the window 10 is at a first position relative to the housing 2. FIG. 2B shows the system 1 in a second configuration in which the window 10 is at a second position relative to the housing 2. The second position of the window 10, shown in FIG. 2B, is lower relative to the housing 2 than the first position of the window 10, shown in FIG. 2A.

A user 20 of the system 1 is positioned so as to look through the window 10. Visibility area 21 of the user 20 represents the area that can be seen by the user 20 when focussing on a particular area outside the window 10. When the window 10 is in its first position, shown in FIG. 2A, the user 20 is looking out of the second window heating zone 4. However when the window 10 has moved to its second position within the housing 2, shown in FIG. 2B, to look at the same area the user 20 must now look out of the first window heating zone 3.

If the window 10 becomes iced or fogged etc. an actuator 11 (shown schematically in FIGS. 2A and 2B) is configured to heat at least one of the first and second heating zones 3, 4 by actuating heating device 5 to heat at least one of the heating zones 3, 4. The actuator 11 is configured to actuate the heating device 5 based the position of the window 10 within the housing 2 and/or the height of the eye line of the user 20 (defining the area 21).

Referring to FIG. 2A, when the window 10 is in its first position the actuator 11 may be configured to actuate the heating device 5 to heat the first window heating zone 3 so that this portion of the window 10 can be de-iced or defogged, based on the eye line of the user 20 or the position of the window 10 within the housing. The system 1 may therefore be configured to heat only the portion of the window 10 that is preventing the user 20 from viewing the area of interest outside of the system 1. Referring to FIG. 2B, when the window 10 is in its second position the actuator 11 may be configured to actuate the heating device 5 to heat the second window heating zone 4 so that this portion of the window 10 can be de-iced or defogged, based on the eye line of the user 20 or the position of the window 10 within the housing. The system 1 may therefore be configured to heat only the portion of the window 10 that is preventing the user 20 from viewing the area of interest outside of the system 1.

With reference to FIG. 1 heating the first window heating zone 3 may comprise actuating the heating element 7 to heat the first window heating zone 3, and/or heating the second window heating zone 4 may comprise actuating the heating element 8 to heat the second window heating zone 4.

According to FIGS. 2A and 2B the system 1 may therefore be automatically actuated to heat a specific area of the window 10. The actuator 11 may be configured to heat the first window heating zone 3 when the window 10 is in its position within the housing 2 as shown in FIG. 2A and the actuator may be configured to heat the second window heating zone 4 when the window 10 is in its second position within the housing 2 as shown in FIG. 2B. Alternatively, or in addition, the actuator 11 may be configured to heat the first window heating zone 3 when the user's eye line is determined relative to the position of the window shown in FIG. 2A and the actuator 11 may be configured to heat the second window heating zone 4 when the user's eye line is determined relative to the position of the window shown in FIG. 2B.

In an arrangement, the system 1 may be used in a motor vehicle (not shown in FIGS. 1-2). The user 20 may be any occupant of the vehicle, for example a driver of the vehicle. The window 10 may be a side window, for example the window adjacent the driver 20 of the vehicle. The housing 2 may comprise part of the side door frame of the vehicle. The system 1 may therefore be used in a side door of a motor vehicle. The first window position, as shown in FIG. 2A, may represent the side window in its fully closed position, i.e. when the window is not open. In such a position the driver may have manipulated a window control to raise the window to its fully closed position. The second window position, as shown in FIG. 2B may represent the side window in a partially open position. In such a position the diver may have manipulated a window control to lower the window to a position that is not fully open. The visibility area 21 of the user 20 when driving the vehicle may represent the user checking their blind spot or a wing mirror. Therefore, according to FIG. 2A when the window 10 while in its first position becomes iced or fogged the actuator 11 can determine that the area of the window 10 to be de-iced or defogged is the first window heating area 3, and the actuator 11 configures the heating device 5 to heat the first window heating area 3 accordingly. When the window 10 while in its second position (FIG. 2B) becomes iced or fogged the actuator 11 can determine that the area of the window 10 to be de-iced or defogged is the second window heating area 4, and the actuator 11 configures the heating device 5 to heat the second window heating area 4 accordingly.

Figure 3A:
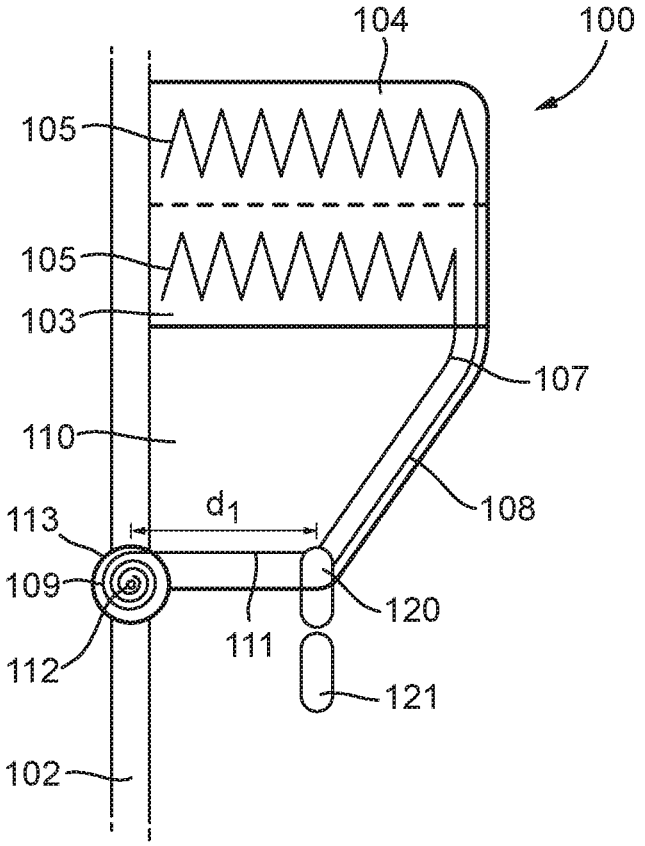
FIGS. 3A and 3B are perspective views of a system for heating a window according to an arrangement of the invention.
Figure 3B:
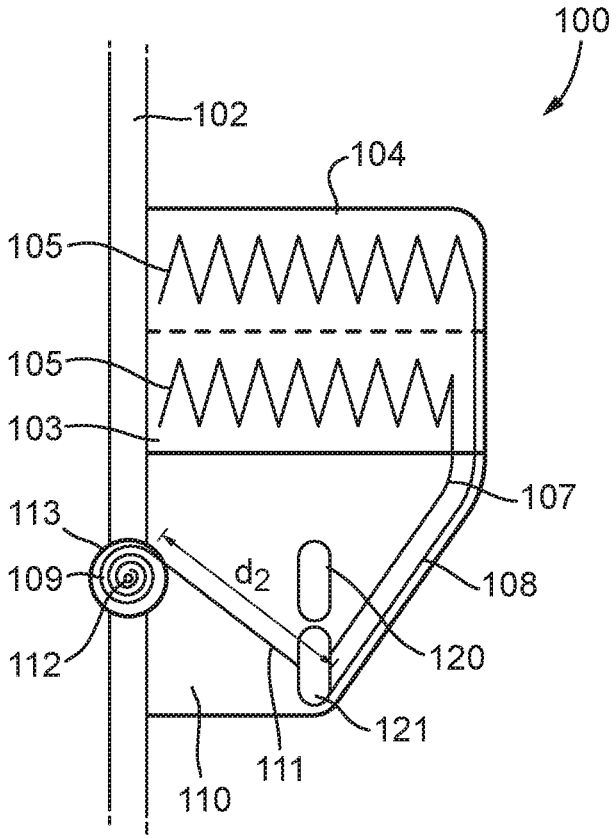

FIGS. 3A and 3B show a system 100 according to an arrangement of the invention. The system 100 comprises a window 110 movably disposed within a housing 102 and comprises a first window heating zone 103 and a second window heating zone 104. A heating device 105 is provided for heating at least one of the first and second window heating zones 103, 104. An actuator 109 is provided and is configured to determine which of the first and second heating zones 103, 104, to heat depending on at least one of: the position of the window 110 within the housing 102, and the height of an eye line of a user of the system.

The actuator 109 comprises an electrical conductor 111 that is wound around a core 112 of the actuator 112. The system 110 is therefore configured to provide continuous electrical connection to the heating device 5 via conductor 111 and the actuator 109 is configured to manage the length of the conductor 111 relative to the movement of the window 110. The actuator 109 may therefore be configured to permit clockwise and anticlockwise movement of the conductor 111 about actuator core 112. The actuator core 112 may therefore be movable, for example rotatable, about an actuator housing 113. The actuator 109 may comprise a biasing element (now shown) to maintain the conductor 111 at a predetermined tension to ensure that the conductor 111 is not slacked. The biasing element may be configured to exert a pulling force on the conductor 111. The biasing element may therefore be configured to ensure that the conductor 111 stays straight and not loose.

The heating device 5 comprises a first heating element 107 configured to heat the first window heating zone 103 and a second heating element 108 configured to heat the second window heating zone 104.

The system 100 comprises a first electrical contact 120 and a second electrical contact 121. The first electrical contact 120 is configured to transmit electrical power to the first heating element 107 to thereby heat the first window heating zone 103 and the second electrical contact 121 is configured to transmit electrical power to the second heating element 108 to thereby heat the second window heating zone 104.

FIG. 3A shows the system 110 in the first configuration in which the window 110 is at a first position relative to the housing 102. FIG. 3B shows the system 100 in a second configuration in which the window 110 is at a second position relative to the housing 102. The second position of the window 110 shown in FIG. 3B, is lower relative to the housing 102 than the first position of the window 110 shown in FIG. 3A.

When the window 110 is in its first position shown in FIG. 3A the conductor 111 is at a length L1 and makes electrical contact with the first electrical contact 120. Electrical power may be supplied from a power source (not shown) via the conductor 111 and first electrical contact 120 to the first heating element 107 to heat the first window heating zone 103.

When the window 110 is in its second position shown in FIG. 3B the conductor 111 is at a length L2 and makes electrical contact with the second electrical contact 121. Electrical power may be supplied from a power source (not shown) via the conductor 111 and second electrical contact 121 to the second heating element 108 to heat the first window heating zone 104.

The actuator 109 is therefore configured to heat at least one of the first and second window heating zones 103, 104 depending on contact between a conductor 111 and at least one of the electrical contacts 120, 121.

Movement of the window 110 may therefore disrupt electrical contact between a power supply and the heating element 105.

In an alternative arrangement electrical contacts may be omitted but the system may comprise a controller configured to actuate the heating device 5 to heat at least one of the first and second heating zones 103, 104 based on the length of the conductor 111. When the window 110 is in its first position (shown in FIG. 3A) the controller may detect the length of the conductor to be length L1 and may be configured to supply power to the first heating element 107 to heat the first window hearting zone 103. When the window 110 is in its second position (shown in FIG. 3B) the controller may detect the length of the conductor to be length L2 and may be configured to supply power to the second heating element 108 to heat the second window heating zone 104. The length of the conductor may be inferred by measuring inductance. As the length of the conductor decreases more of the conductor is mound onto the actuator core 112 and the inductance will increase.

In a further alternative arrangement, the system may comprise a controller configured to actuate the heating device 5 to heat at least one of the first and second heating zones 103, 104 based on the angle that the conductor 111 makes relative to the position of the actuator 109. When the window 110 is in its first position (shown in FIG. 3A) the controller may detect the angle that the conductor makes relative to the actuator 109 to be approximately 0 degrees, or in another example, a minimum angle or angle A1. When the controller detects such an angle the controller may be configured to supply power to the first heating element 107 to heat the first window hearting zone 103. When the window 110 is in its second position (shown in FIG. 3B) the controller may detect the angle that the conductor makes relative to the actuator 109 to be not zero degrees, or in another example, a maximum angle or angle A2 such that A2 is greater than A1. When the controller detects such an angle the controller may be configured to supply power to the second heating element 108 to heat the second window heating zone 104.

The contacts 120, 121 may be disposed on the housing 102 or in, or on, the window 110. In some arrangements, the actuator may be mounted or attached to the window 110 and slidably movable relative to the housing with the window.

It will be appreciated that movement of the window 110 within the housing will cause the length of conductor to change. It will also be appreciated that, in the arrangement shown in FIGS. 3A and 3B the conductor will be further wound around the core 112 of the actuator 109 to decrease its length when the window 110 moves from its second position (shown in FIG. 3B) to its first position (shown in FIG. 3A).

In one example arrangement the actuator may be positioned on the housing approximately in the centre of a window movement path of the window. The length of the conductor may therefore be at a minimum when the window is approximately in the centre if its movement path, and at maximums at either end of the window movement path. It will therefore be appreciated that when the actuator is disposed at a central position in the window movement path that when the window is in its first position of maximum height relative to the housing the length of conductor may be at a maximum. Downward movement of the window within the housing will cause the actuator and the heating device to become closer and as such cause the length of the conductor to decrease as it is wound around the core of the actuator. Further downward movement of the window may cause the actuator and the heating device to become further away from one another and the window may cause the length of the conductor to increase as the conductor is pulled from the actuator.

Figure 4A:
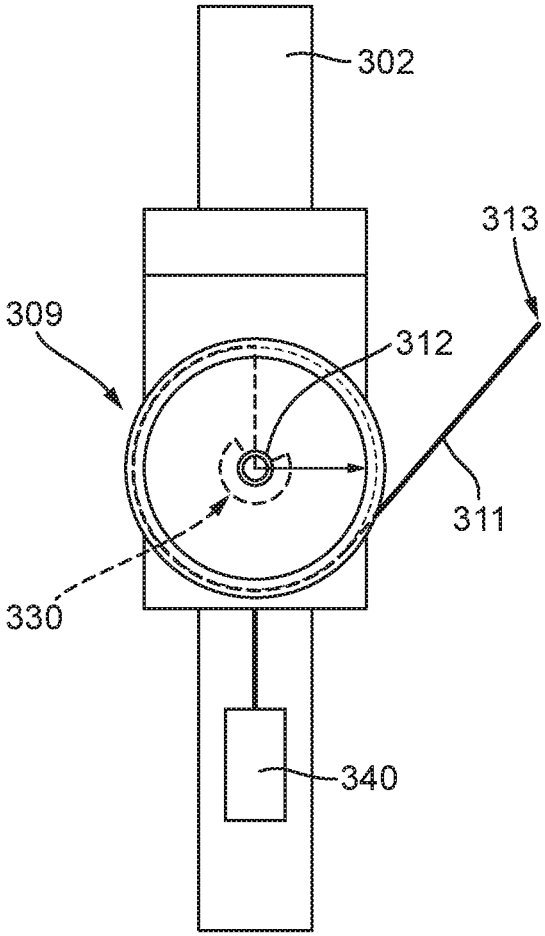
FIGS. 4A and 4B are front and side views, respectively, of an actuator that could be used in the system of the present invention.
Figure 4B:
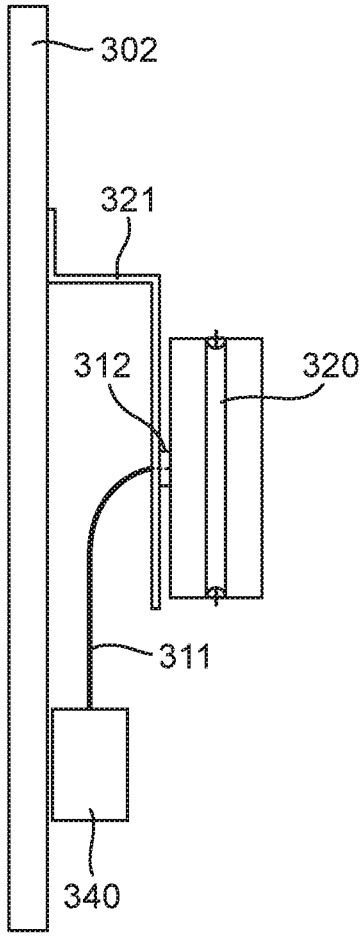

An example actuator according to an arrangement of the invention is shown in FIG. 4. FIG. 4A shows a front view of the actuator 309 and FIG. 4B shows a side view of the actuator 309. The actuator 309 may comprise an outer groove 320 for housing a conductor 311. A fixed support 321 such as a bracket secures the actuator 309 to housing 302. In the arrangement shown in FIGS. 4A and 4B the actuator 309 comprises a hollow central core 312 for receipt of a conductor 311. The actuator 309 is rotatable relative to the housing 302 about the core 312. The conductor 311 extends from a fixed connector 340 from which the conductor 311 receives power to transmit to the heating element (not shown). The conductor 311 extends from the fixed connector 340 into the hollow central core 312, as shown in FIG. 4B. As shown in FIG. 4A the conductor exits the hollow central core 312 via a slot (not shown) and is disposed around the actuator 309 in the outer groove 320. The end 315 of the connector 311 extends to a heating device for heating at least one of the first and second window heating zones.

A biasing element indicated at 330 may bias the actuator 309 into a rotational orientation in which the conductor 311 is at its shortest length. For example, if the actuator of FIG. 4 were used in the arrangement of FIGS. 3A and 3B the biasing element may bias the actuator into the rotational orientation in which the conductor 111 was at length L1, shown in FIG. 3A. This ensures that, when the window is moving (e.g. to the position of FIG. 3A) so as to increase the conductor length, that the conductor is biased to its shortest length. This will also ensure that the conductor is biased to a tension, which may be predetermined. This will therefore ensure that the conductor will stay straight regardless of the position of the window relative to the actuator. The biasing element may comprise a spring, such as a spiral torsion spring.

Movement of the window will overcome any biasing force exerted by the biasing element 330. Therefore when the window is moving to a position requiring the conductor to be drawn out of the actuator (for example, movement from the FIG. 3A position to the FIG. 3B position), the window movement will cause the actuator to rotate (clockwise in FIG. 4A), overcoming the bias of the biasing element 330, such that the conductor 311 is effectively pulled out of the actuator 309. When the window is moving to a position requiring the conductor to shorten its length (for example, movement from the FIG. 3B position to the FIG. 3A position), the bias exerted by the biasing element 330 will cause the actuator 309 to effectively wind in the conductor to reduce its length.

The rotational position of the actuator 309 may determine which window heating zone to heat. Each window heating zone may have an associated contact for proving power to heat that zone and the rotational position of the actuator 309 may determine which contact is electrically connected to a power source.

In arrangements of the invention the window is a first window and the actuator may comprise a controller configured to actuate heating of one of the window heating zones at the same time as actuating heating of a second window. For example, in one example arrangement the system is configured for use with a vehicle comprising front and rear windows. The actuator may be configured to actuate at least one of the first and second window heating zones at the same time as a heating function of at least one of the front and rear windows is actuated.

While the invention has been illustrated and described in detail in the drawings and foregoing description, such illustration and description are to be considered illustrative or exemplary and not restrictive; the invention is not limited to the disclosed embodiments. Various alternative examples are discussed through the detailed description. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. Any reference signs in the claims should not be construed as limiting the scope.

The invention claimed is:

1. A system, comprising:

a window movably disposed within a housing, the window comprising a first window heating zone and a second window heating zone;

a heating device for heating at least one of the first window heating zone and the second window heating zone; and an actuator configured to determine which of the first and second window heating zones selectively to heat depending on at least one of: a length of a conductor between the actuator and the heating device, an angle that the conductor makes with the housing, and a rotational position of the actuator.

2. The system of claim 1, wherein the heating device comprises at least one heating element, and wherein each of the first and second window heating zones comprises the at least one heating element.

3. The system of claim 1, further comprising at least one electrical contact for transmitting power to the heating device, wherein the actuator is configured to selectively engage or disengage the at least one electrical contact from a power supply to selectively heat at least one of the first and second window heating zones.

4. The system of claim 3, wherein the at least one electrical contact is provided for each of the first and second window heating zones.

5. The system of claim 1, wherein the actuator comprises a sensor configured to sense a position of the window relative to the housing, the actuator being configured to actuate the heating device to heat at least one of the first and second window heating zones based on measurements of the sensor.

6. The system of claim 1, further comprising a conductor for supplying power to the heating device, wherein the conductor extends between the actuator and the heating device, and wherein the actuator is configured to manage a length of the conductor between the actuator and the heating device.

7. The system of claim 6, wherein the actuator is rotatable and the conductor is wound around a core of the actuator, wherein rotational movement of the actuator varies the length of the conductor between the actuator and the heating device.

8. The system of claim 1, further comprising at least one electrical contact for supplying power to the heating device, wherein the actuator is configured to selectively engage or disengage the at least one electrical contact from a power supply to selectively heat at least one of the first and second window heating zones based on at least one of: the length of conductor between the actuator and the heating device, the angle that the conductor makes with the housing, and the rotational position of the actuator.

9. The system of claim 6, further comprising a biasing element for maintaining the conductor at a tension above a predetermined level.

10. The system of claim 9, wherein the biasing element is configured to bias the actuator into a first rotational position.

11. The system of claim 1, wherein the window is movable within a window movement range between a first window position and a second window position, relative to the housing, and wherein the actuator is positioned on the housing in approximately a center of the window movement range.

12. The system of claim 1, wherein the actuator is configured to power the heating device when the window is not moving relative to the housing, and to disrupt power to the heating device when the window is moving relative to the housing.

13. A vehicle comprising the system of claim 1, wherein a side of the vehicle comprises the housing, wherein at least one of a front side window and a back side window comprises the window, and wherein the actuator is configured to power the heating device to heat at least one of the first and second window heating zones based on a heating function of at least one of front and back side windows of the vehicle being activated.

14. A method of heating a window, the window comprising a first window heating zone and a second window heating zone, the method comprising:

determining a first eye line of a user at a first time; and selectively heating, based on determining the first eye line, the first window heating zone that corresponds to the first eye line of the user;

determining a second eye line of the user at a second time; and selectively heating, based on determining the second eye line, the second window heating zone that corresponds to the second eye line of the user.

15. A vehicle, comprising:

a window movably disposed within a housing, the window comprising a first window heating zone and a second window heating zone;

a heating device in communication with at least one of the first window heating zone and the second window heating zone, wherein the heating device is configured to heat at least one of the first window heating zone and the second window heating zone; and an actuator configured to determine which of the first window heating zone and the second window heating zone to selectively heat based on at least one of: a length of a conductor between the actuator and the heating device, an angle that the conductor makes with the housing, and a rotational position of the actuator.

16. The vehicle of claim 15, wherein the housing is disposed on a side of the vehicle, wherein the window comprises a front side window and a back side window, and wherein the actuator is configured to power the heating device to heat at least one of the first and second window heating zones based on a heating function of at least one of the front side window and the back side window.

17. The vehicle of claim 15, wherein the heating device comprises a first heating element and a second heating element, and wherein the first window heating zone comprises the first heating element and the second window heating zone comprises the second heating element.

18. The vehicle of claim 15, further comprising at least one electrical contact configured to transmit power to the heating device, wherein the actuator is configured to selectively engage or disengage the at least one electrical contact from a power supply to selectively heat at least one of the first window heating zone and the second window heating zone.

19. The vehicle of claim 18, wherein the at least one electrical contact comprises a first electrical contact and a second electrical contact, and wherein the first window heating zone comprises the first electrical contact and the second window heating zone comprises the second electrical contact.

* * * * *